US007140332B2

(12) United States Patent
Klein et al.

(10) Patent No.: US 7,140,332 B2
(45) Date of Patent: Nov. 28, 2006

(54) PNEUMATICALLY ACTUATED VALVE FOR INTERNAL COMBUSTION ENGINES

(76) Inventors: Jeffrey F. Klein, 8106 Tichenor Point Ct., Millersville, MD (US) 21108; Konstantin Mikhailov, 3637 Chadwick Ct., Pasadena, MD (US) 21122

( * ) Notice: Subject to any disclaimer, the term of this patent is extended or adjusted under 35 U.S.C. 154(b) by 0 days.

(21) Appl. No.: 10/543,985

(22) PCT Filed: Jan. 30, 2004

(86) PCT No.: PCT/US2004/002514

§ 371 (c)(1),
(2), (4) Date: Jul. 29, 2005

(87) PCT Pub. No.: WO2004/070239

PCT Pub. Date: Aug. 19, 2004

(65) Prior Publication Data

US 2006/0236959 A1 Oct. 26, 2006

Related U.S. Application Data

(60) Provisional application No. 60/444,532, filed on Jan. 31, 2003.

(51) Int. Cl.
*F01L 9/02* (2006.01)

(52) U.S. Cl. ..... 123/90.14; 123/90.15; 123/90.12

(58) Field of Classification Search ..... None
See application file for complete search history.

(56) References Cited

U.S. PATENT DOCUMENTS 6,257,180 B1 * 7/2001 Klein ..... 123/70 R
6,349,691 B1 * 2/2002 Klein ..... 123/188.4

* cited by examiner

*Primary Examiner*—Thomas Denion
*Assistant Examiner*—Zelalem Eshete
(74) *Attorney, Agent, or Firm*—Ober/Kaler c/o Royal W. Craig

(57) ABSTRACT

A pneumatically actuated valve assembly for use as intake and/or exhaust valves on two- or four-stroke internal combustion engines. The assembly includes a valve (100), valve housing (200), and compressed gas distribution and timing mechanisms (FIGS. 5–8). The valve (100) is comprised of a short light weight hollow cylindrical body with a capped lower end and an opened upper end. The valve is further defined by a plurality of ports (104) adjacent to the lower end and a collar (198) encircling the body adjacent the upper end. The valve housing (200) is hollow and tubular having a larger diameter upper section and a smaller diameter lower section in which the valve (100) slides up to close and down to open. The housing (200) further includes hollow channels which direct compressed gas, managed by the distribution and timing mechanism, alternately towards the areas above and below the valve collar at regular intervals to open and close the valve, respectively.

16 Claims, 8 Drawing Sheets

PNEUMATICALLY ACTUATED VALVE FOR INTERNAL COMBUSTION ENGINES

CROSS-REFERENCE TO RELATED APPLICATIONS

The present application is related to U.S. Pat. No. 6,349,691 issued on Feb. 26, 2002 for an "Automatic, Pressure Responsive Air Intake Valve for Internal Combustion Engine". It is further related to U.S. Provisional Patent Application No. 60/444,532 for an Energy Efficient Intake Valve Assembly filed on Jan. 31, 2003.

TECHNICAL FIELD

The present invention relates to a valve and, more particularly, to a pneumatically actuated valve for use as an intake and/or exhaust valve on either a two- or four-stroke internal combustion engine.

BACKGROUND ART

Generally, four stroke internal combustion engines utilized valves to allow exhaust to leave the working (combustion) chamber of the engine cylinder after the combustion stroke, as well as to allow a new air charge to enter the cylinder to begin the cycle anew during the intake stroke. Two stroke internal combustion engines on the other hand may utilize valves for both intake and exhaust or a valve for intake and a port for exhaust. Such valves have traditionally been invariably actuated by a cam affixed to a shaft (the cam shaft), or alternatively by an electromagnetic or hydraulic device.

It would be greatly advantageous to provide another more efficient way to actuate valve reciprocation on internal combustion engines. Valves which rely on a cam shaft usually require heavy springs and a large number of other moving parts that absorb a large amount of energy and create a great deal of friction. Additionally, such systems are relatively expensive to operate.

U.S. Pat. No. 6,349,691 to Klein (one of the inventors named herein) describes a partial solution in the form of a valve for air intake. The valve is responsive to pressure differential between the manifold and combustion chamber. Specifically, the valve closes in response to the increase in pressure in the cylinder as the piston rises (after passing bottom dead center and approaching the top of the cylinder). Unfortunately, a problem with this intake valve assembly is that inertia and, to a lesser extent friction, retards the valve's speedy closure, thus negatively affecting engine performance.

Therefore, it would be advantageous to provide an externally regulated pressure actuated valve system.

The present inventors have also filed U.S. patent application Ser. No. 10/449,754 on May 30, 2003, which introduces a system of using a spring to accelerate the valve closing, and a means to vary non-cyclically the base force of the spring so that the proper amount of spring force can be used under varying conditions of engine speed and load. While this variable spring force intake valve system is reliable, it still presents a lingering concern. Specifically, when the spring force is adjusted (i.e. during a regime of higher engine speed) the period of time during which the valve is open to allow ventilation is shortened. Thus, an insufficient amount of intake air enters the cylinders, negatively effecting engine performance.

Additionally, the present inventors have filed a U.S. Provisional Patent Application No. 60/444,532 on Jan. 31, 2003, which introduced another more energy efficient intake valve assembly. The provisional patent application disclosed both a unique compressed air actuated intake valve system (either wholly air operated or spring-assisted) and a unique air distribution system using a single air source for actuating the intake valve. The valve is short and lightweight, having collar. The valve sits in a housing atop an engine cylinder and is connected to the air distribution system. Compressed air is either directed over the top of the valve forcing it downward and open or into a hollow chamber within the valve housing where the compressed-air applies pressure under the valve collar, forcing the valve upward and closed. The disclosed air distribution system uses a rotating disk assembly with air outlets to direct airflow as necessary to raise and lower the valve. While the valve assembly disclosed in this provisional patent application is sound, there is a slight disadvantage associated with this air distribution system. Namely, the air distribution system, as disclosed, requires lubrication for the rotating disks and upon heating the presently available lubrications may release unwanted and harmful hydrocarbons into the atmosphere. Additionally, the valve was illustrated for use only as an intake valve, not as either an intake or exhaust valve.

It would be advantageous over the prior art to provide a wholly forced-air actuated valve system, using one or multiple air sources, operable on either a four stroke or a two stroke internal combustion engine, to open and/or close intake and/or exhaust valves. It would also be advantageous to provide a system for efficiently regulating the timing of the valve open/close (reciprocation) cycle relative to the engine speed. It would further be advantageous to provide such a system that does not require the use of lubricants that may release harmful by-products into the environment.

DISCLOSURE OF INVENTION

The present invention is a wholly pneumatically actuated valve assembly including a valve, a valve housing, and a compressed-air or other gas distribution and timing mechanism. The valve assembly is similar to the sliding valve assembly, described in U.S. Pat. No. 6,349,691, having been modified and improved such that it is able to accommodate forced-air actuated reciprocation. Specifically, the valve is comprised of a relatively short and low mass hollow cylindrical body with an upper and lower end. Encircling and either attached to or formed as an integral part of the hollow cylindrical body towards the upper end is a collar. The upper end of the cylindrical body is opened. The lower end of the hollow cylindrical body includes a plurality of ports (i.e. elliptical ports) along the circumference and an endplate or cap closing the lower end of the hollow cylindrical body. The lower end of the cylinder is slightly flared (i.e. 45 degree angle) to form a valve seat. The valve is positioned in a hollow tubular housing that creates a passage through the engine's cylinder head to the combustion chamber. Sliding the valve up and down within the housing closes and opens the valve, respectively. The housing has two inner sections with differing diameters, a smaller diameter lower section adjacent to a larger diameter upper section. The smaller diameter lower section of the housing is nearest of the combustion chamber and its diameter is such that it accommodates with minimal clearance the sliding movement of the valve body. The larger diameter upper section is nearest the outer surface of the engine and its diameter is such that it accommodates with minimal clearance the sliding of the valve collar. The adjacent position of the differing diameter housing sections necessarily creates a shelf that limits the downward motion of the valve.

Additionally, the valve housing may be configured with a housing cap attached to the upper section of the housing adjacent the outer surface of the engine. This cap covers the collar but not the open upper end of the hollow cylindrical body.

The valve is actuated by directing forced air towards one or more actuation areas, relative to the valve collar to force the valve to slide up or down. For valve assemblies in which compressed air is used only to close the valve, there is one actuation area beneath the valve collar. If compressed air is used to both open and close the valve, there are two actuation areas, one above and one below the valve collar. In both embodiments, the valve housing contains a hollow air feed channel with one end connected to a forced air source and the other end opening into the valve seat beneath the valve collar. Thus, the valve, particularly the underside of the valve collar, is exposed to the channel. For valves with two actuation areas, the housing cap further comprises a hollow air feed channel with one end connected to a forced air source and the other end opening into the valve seat above the valve collar. Thus, the valve, particularly the top of the valve collar, is exposed to the hollow channel. Forced air alternately directed into these hollow air feed channels will close and open the valve, respectively.

Compressed air, either from a single or multiple sources, is manifolded to the hollow air feed channels. Forced air distribution and timing mechanisms are used to regulate forced air flow into the hollow air feed channels in order to actuate and control valve reciprocation.

Alternative embodiments, utilize a vacuum in the area under the valve collar in order to slide the valve downward and open in conjunction with compressed air forced under the valve collar to slide the valve upward and closed.

In the preferred embodiment of the present invention an electromechanical valve assembly regulated by a programmable controller is used as the forced air distribution and timing mechanism. In another embodiment a rotational disk assembly secured within an air input manifold is used to regulate distribution and timing of forced air flow.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 3 further illustrates a rotational disk assembly secured within an air input manifold to regulate forced air distribution and timing.

FIG. 4 further illustrates an electromechanical valve assembly regulated by a programmable controller to regulate forced air distribution and timing.

BEST MODE(S) FOR CARRYING OUT THE INVENTION

The present invention is a pneumatically actuated valve assembly for use as exhaust and/or intake valve on either two- or four-stroke internal combustion engines, inclusive of the pneumatically actuated valve itself, plus forced air distribution and timing mechanisms for controlling the valve. While the assembly is described herein as being pneumatically actuated by means of forced or compressed air, one skilled in the art will recognize that other pressurized gases may be suitable for actuating the valve of the present invention.

Figure 1:
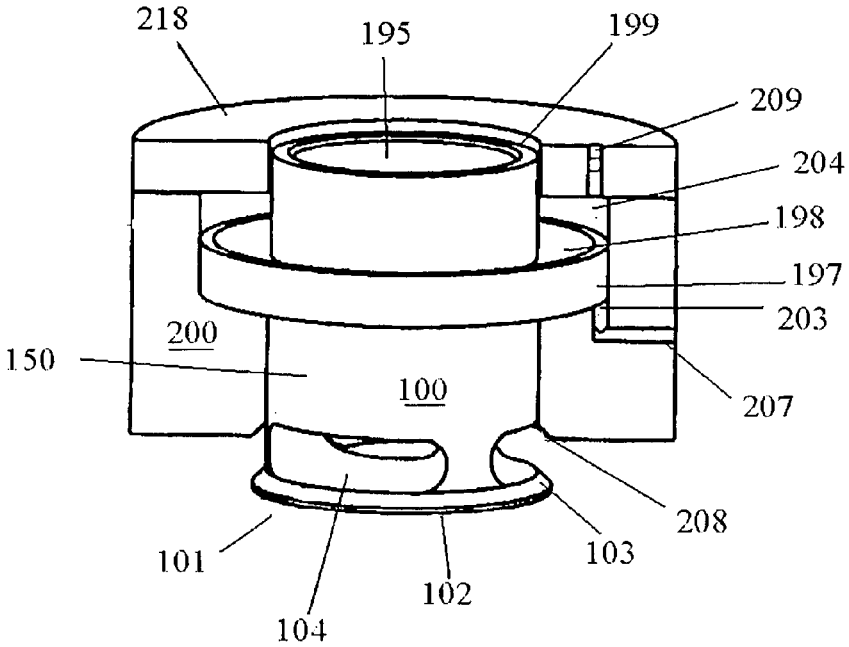
FIG. 1 illustrates the structural features of an exemplary compressed air actuated valve of the present invention.

FIG. 1 depicts the structural features of an exemplary pneumatically actuated valve 100 for use with internal combustion engines according to the present invention. The pneumatically actuated valve assembly generally includes a valve 100, a valve housing 200 and an air distribution and timing mechanism 300 (to be described with reference to FIG. 3). The various components are described in more detail as follows.

Valve 100 and Valve Housing 200

The valve 100 includes a hollow, cylindrical body 150 with an upper end 199 and a lower end 101. The lower end 101 is capped by an endplate 102 forming a valve seat 103 that conforms to an annular groove in the housing 200. For example, the valve seat 103 may have a slightly angled (45 degree) surface that mates with a conforming angled surface 208 of the groove (See FIG. 2B) on the housing 200 when the valve 100 is in the closed (up) position. The upper end 199 is open (aperture 195). The body 150 is further defined by a plurality of ports 104 around its circumference adjacent the valve foot 103. Additionally, a collar 198 encircles and is attached to or formed as an integral part of the body 150 above the ports 104 at or near the upper end 199. This collar 198 resembles a flat round washer and may include a tubular parapet 197.

Figure 2A:
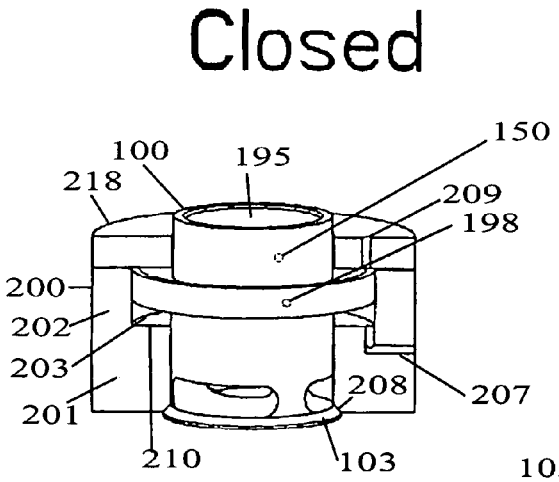
FIGS. 2A and 2B illustrate the valve of FIG. 1 as positioned in the valve housing in the closed and open positions, respectively.
Figure 2B:
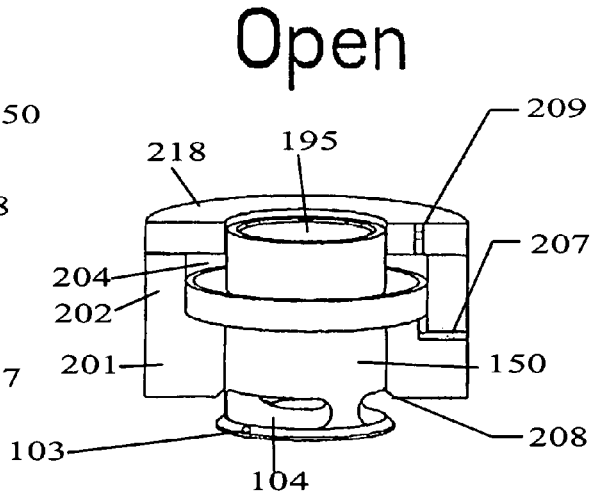

FIGS. 2A and 2B illustrate the valve of FIG. 1 as seated in the valve housing 200 in the closed and open positions, respectively. The valve 100 is sits in a hollow tubular housing 200 having two adjacent inner sections with differing diameters, a smaller diameter lower section 201 and a larger diameter upper section 202.

Figure 3:
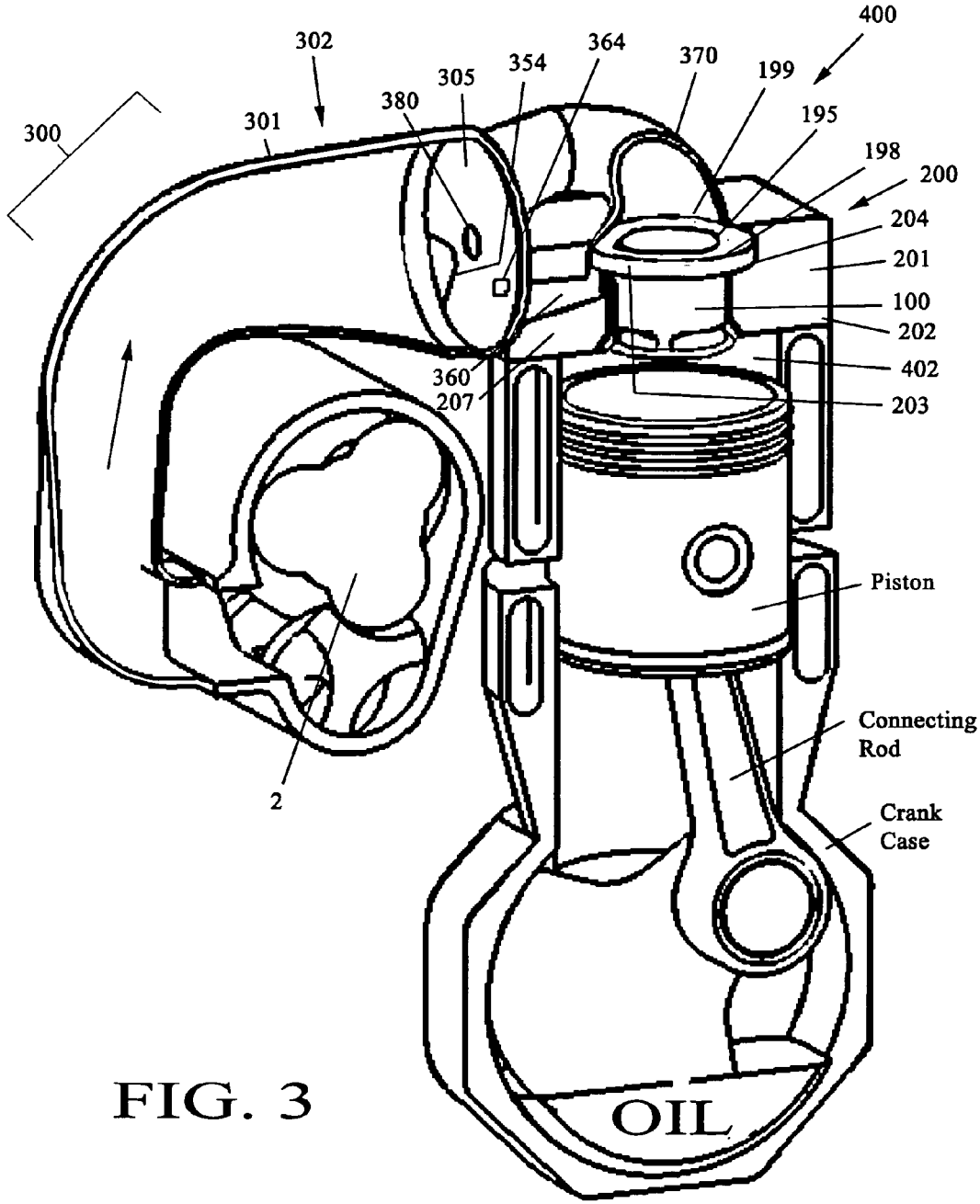
FIG. 3 is an illustration of a two-stroke internal combustion engine employing the valve and valve housing of FIG. 1 as an air intake valve.
Figure 4:
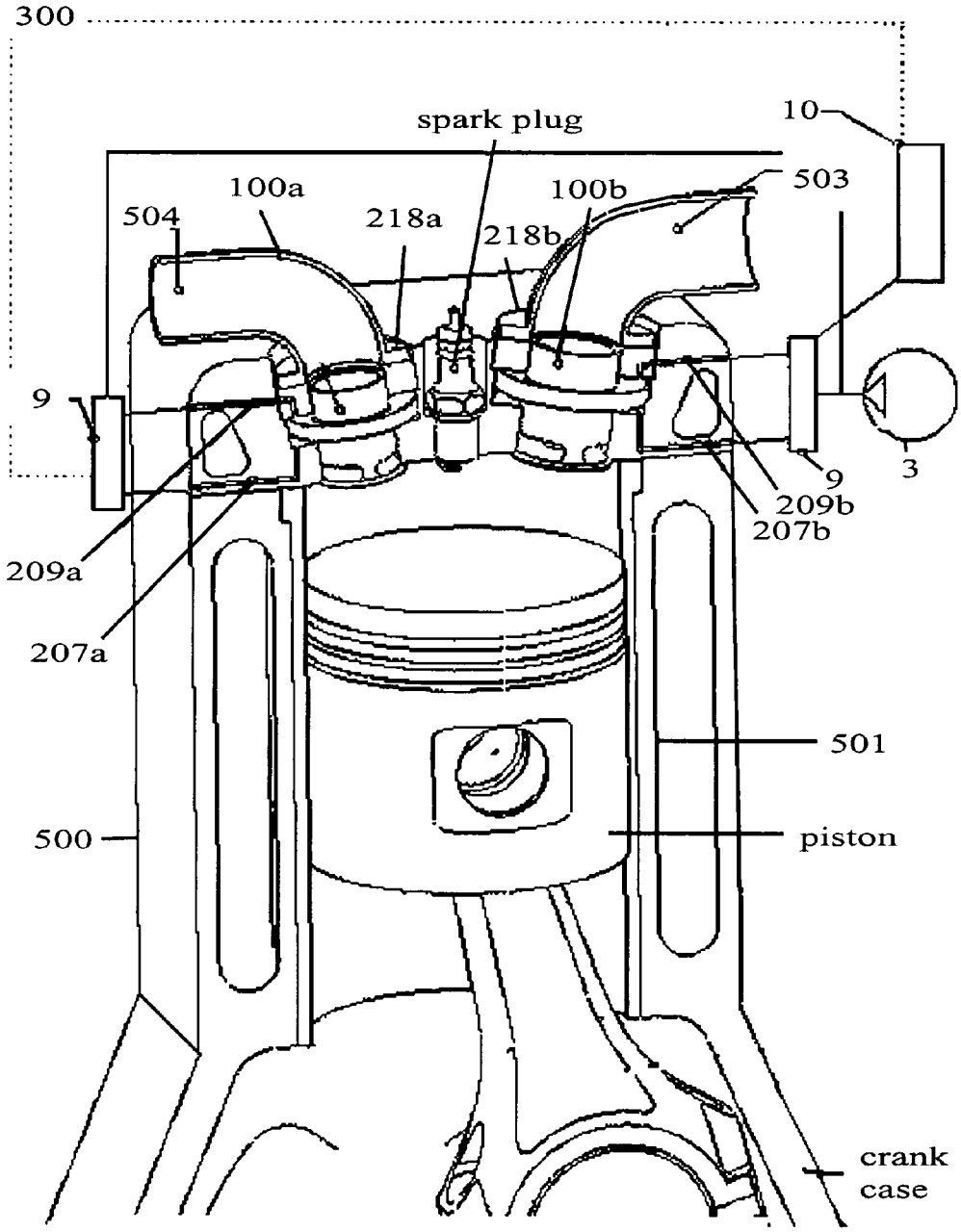
FIG. 4 is an illustration of a four-stroke internal combustion engine employing the present invention for both intake and exhaust valves.

FIG. 3 illustrates the valve 100 and valve housing 200 of FIGS. 1–2 as an air intake valve in the context of a two-stroke internal combustion with a regulated forced air distribution and timing mechanism. FIG. 4 illustrates the valve 100 and valve housing 200 of FIGS. 1–2 as both air intake and exhaust valves in the context of a four-stroke internal combustion engine.

With combined reference to FIGS. 1–4, the housing 200 creates a passage in the engine's cylinder head from the outer surface of the engine through to the combustion chamber (See FIGS. 3 and 4). The valve 100 sliding up and down in the housing 200 closes and opens the valve assembly, respectively. Specifically, sliding the valve down causes ports 104 to open into the combustion chamber creating a channel (defined by ports 104, hollow body 150 and aperture 195) through which gases may pass either into or out of the combustion chamber, depending upon valve function. Thus, an open intake valve assembly as seen in FIG. 3 allows air and fuel to pass into aperture 195 through the hollow cylindrical body 150 and out the ports 104. An open exhaust valve 100*b* as seen in FIG. 4 allows exhaust gases to leave the combustion chamber of the engine through the ports 104 into hollow cylindrical body 150 and into the engine exhaust system (not shown).

The length of valve 100 is relatively short and wide, compared to conventional internal combustion engine valves which require long thin bodies. The valve length is approximately equal to the thickness of the engine cylinder head in which it is seated. The wide cylindrical body 150 of the present valve 100 makes the valve less likely to suffer the effects of wear and tear as compared to conventional valves.

As discussed above, the hollow housing 200 is defined by an annular groove that receives the valve seat 103. The groove may be an angled surface 208 in the housing 200 that opens into the combustion chamber. This angled groove surface 208 mates with valve seat 103 to ensure that no gases pass into or out of the combustion chamber when the valve 100 is closed. The hollow tubular housing 200 is defined by a smaller diameter section 201 adjacent to a larger diameter section 202. The smaller diameter section 201 is sized to accommodate the valve body 150 with some clearance. The larger diameter section 202 is sized to accommodate the valve collar 198 with some clearance. The adjacent positioning of the two sections (201 and 202) creates a shelf 210 which limits downward motion of the valve, and on which the collar 198 rests when the valve 100 is in the open (down) position.

The embodiment shown in FIGS. 2*a*, 2*b* and 4 employs a housing cap 218 attached to the larger diameter section 202 adjacent to the outer surface of the valve cylinder wall. The housing cap 218 covers the exposed valve collar 198 without covering the open end 195 and without impacting intake or exhaust air flow. The housing cap 218 contains a hollow air feed channel 209 with one end connected to a forced air source and the other end opening the area 204 above the valve collar 198. Thus, the valve 100, particularly the top of the valve collar 198, is exposed to the hollow channel 209. When the valve 100 is closed, forced air directed into the housing cap air feed channel 209 exerts pressure on to the top of the valve collar 198 and forces the closed valve 100 downward and open.

The above-described two-section housing configuration is important toward actuating the valve pneumatically. When the valve 100 is in the up position (FIG. 2A) a hollow area 203 is created beneath the collar 198 and shelf 210. When the valve 100 is in the down position (FIG. 2B) a hollow area 204 is created between the collar 198 and the cap 218.

The valve 100 is actuated by directing forced air into one the "actuation areas" above and/or below the valve collar 198 to force the valve 100 to slide up or down. For valve assemblies in which forced air is used only to close the valve, there is one actuation area beneath the valve collar 198. If compressed air is used to both open and close the valve 100, there are two actuation areas, one above and one below the valve collar 198. In both embodiments, the valve housing 200 contains a hollow air feed channel 207 with one end connected to a forced air source and the other end opening into the shelf 210 beneath the valve collar 198. Thus, the valve 100, particularly the underside of the valve collar 198, is exposed to the channel 207. When the valve is in the open position (100, FIG. 2B), forced air directed into the housing air feed channel 207 exerts pressure to the underside of the valve collar 198, causing the valve 100 to move upward and closed.

For valves 100 with that use forced air to both open and close the valve, the valve housing 200 need not be configured with the housing cap 218 as in FIGS. 2*a*, 2*b* and 4. Rather, as seen in FIG. 3, forced air may be manifolded over the entire upper end of the valve serving the dual purposes of opening the valve by applying air pressure to the collar 198, and providing air for the intake stroke.

When the pneumatically actuated valve assembly of the present invention is used as an intake valve 100 on a two-stroke internal combustion engine 400 as seen in FIG. 3, each cylinder 401 head is fitted with one or more intake valves 100 which open into the combustion chamber 402 of the engine 400. As stated above, the present invention depicted in FIG. 3 is not configured with a housing cap. Compressed air is manifolded over the entire upper end 199 of the valve 100. During ventilation (combination intake and exhaust stroke), exhaust is vented through exhaust ports 403. Simultaneously, compressed air from the air distribution and timing mechanism 300 is forced over the upper end 199 of the valve 100, pushing down on the valve collar 198 to open the valve and allowing air to enter the working chamber 402 for combustion and incidental cooling. During the compression stage, the air distribution mechanism 300 forces air into hollow air feed channel 207 causing the intake valve 100 to close. The valve 100 then remains closed through the combustion stage.

FIG. 4 is an exemplary illustration of the cylinder 501 head of a four stroke internal combustion engine 500 incorporating pneumatically-actuated for opening and closing intake 100*b* and exhaust 100*a* valves. The valve housings 200*a* and 200*b* are configured with valve caps 218*a* and 218*b*, respectively. The valve caps 218*a* and *b* are configured with hollow air feed channels 209*a* and *b*, respectively. During the intake stroke, the air distribution mechanism 300 forces air into air feed channel 209*b* causing the intake valve 100*b* to open allowing air to flow into the combustion chamber 502 of the engine 500 from the intake manifold 503 for combustion and incidental cooling. Once compression begins, the air distribution mechanism 300 forces air into air feed channel 207*b* causing the intake valve 100*b* to close. Following the compression and combustion strokes, the air distribution mechanism 300 forces air into air feed channel 209*a* causing the exhaust valve 100*a* to open allowing the exhaust fumes to flow into the exhaust manifold 504. When the intake stroke begins, air distribution mechanism 300 forces air into air feed channel 207*a*, closing the exhaust valve 100*a*.

Air Distribution and Timing Mechanism 300

FIGS. 5–8 are schematic diagrams of four similar embodiments of the forced air distribution and timing mechanisms 300 for the present invention using an electromechanical valve assembly.

Figure 5:
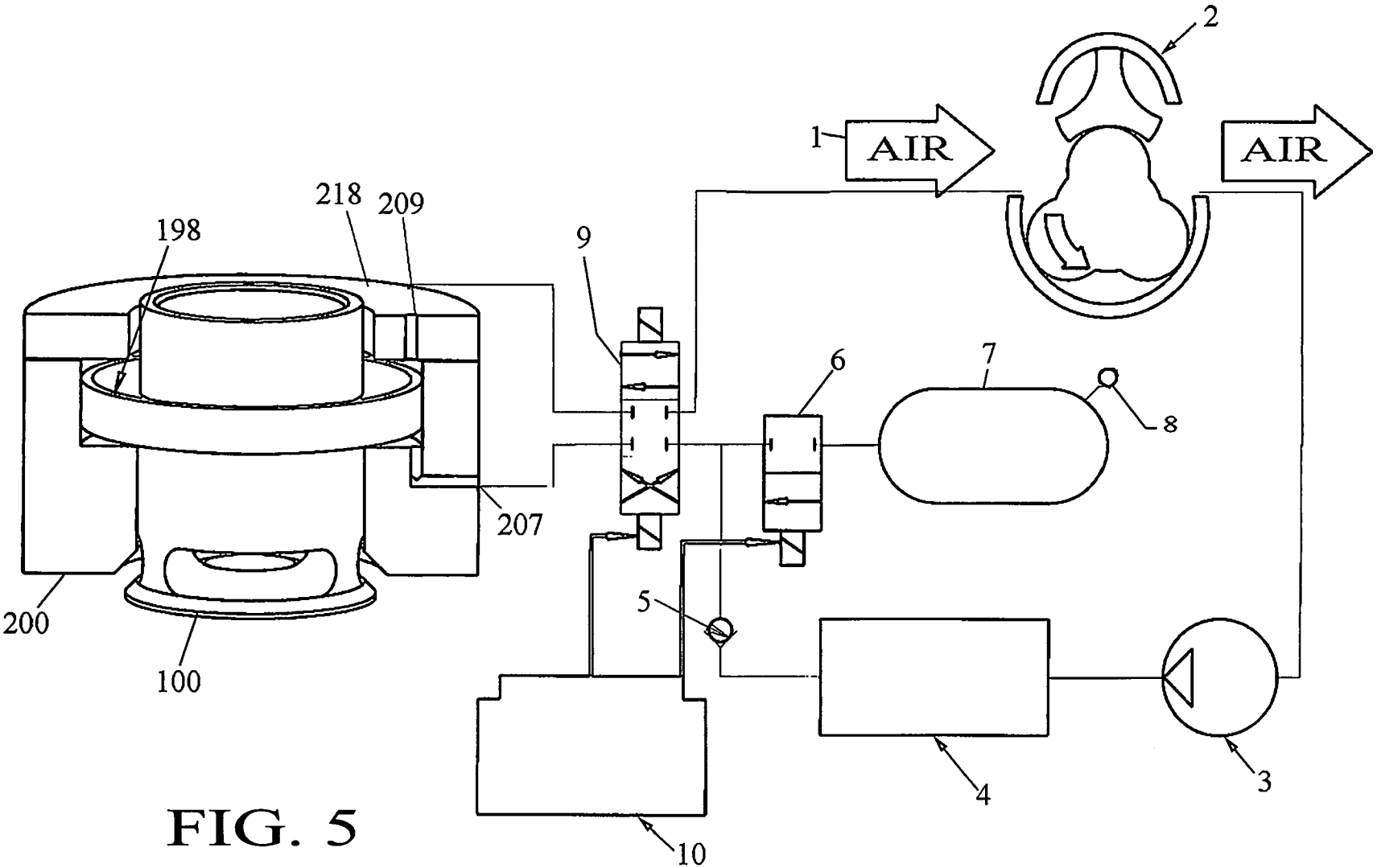
FIGS. 5–8 are operational diagrams illustrating exemplary embodiments of an electro-mechanical valve assembly used to regulate forced air distribution and timing.

Referring to FIG. 5, clean air 1 is fed into a high volume turbocharger 2. The compressed air from the high volume turbocharger 2 is passed through another smaller low volume high pressure compressor 3. As air is compressed the temperature rises and the air expands, which is counter productive. Thus, after passing through the compressor 3, the compressed air is passed through an intercooler 4 to cool. Once cooled, the compressed air 1 flows through a one-way valve 5 to prevent losses due to back pressure. At this point a programmable electronic control module 10 manages the distribution and timing of the flow of forced air 1 as a function of engine speed and load. Most modern automobiles already employ Electronic Control Units (ECU) or Modules (ECM) to monitor sensor inputs and calculate the necessary output signals to the engine control systems, and these existing ECUs or ECMs can be additionally tasked with managing the distribution and timing of the flow of forced air 1. The air 1 is forwarded to the air distribution center 9. However, if the programmable control module 10 receives an indication that the pressure in the system has reached a pre-determined level, then the compressed air is passed to receiver valve 6 and onto receiver 7 (i.e. a compressed air storage tank). Compressed air held within the receiver is stored for later use, i.e. starting the engine. For safety reasons, the receiver 7 preferably also includes a standard pressure relief valve 8. The air distribution center 9 is manifolded to the valve housing such that it may distribute compressed air 1 to the area above 204 or below 203 the valve collar 198 via hollow air feed channels (i.e. 207 and 209) to actuate the opening and closing of the valve 100 in valve housing 200. Those skilled in the art will recognize that electromagnetic air distribution center 9 is an electromagnetic valve assembly and it is standard piece of equipment for pneumatically actuated systems.

Figure 6:
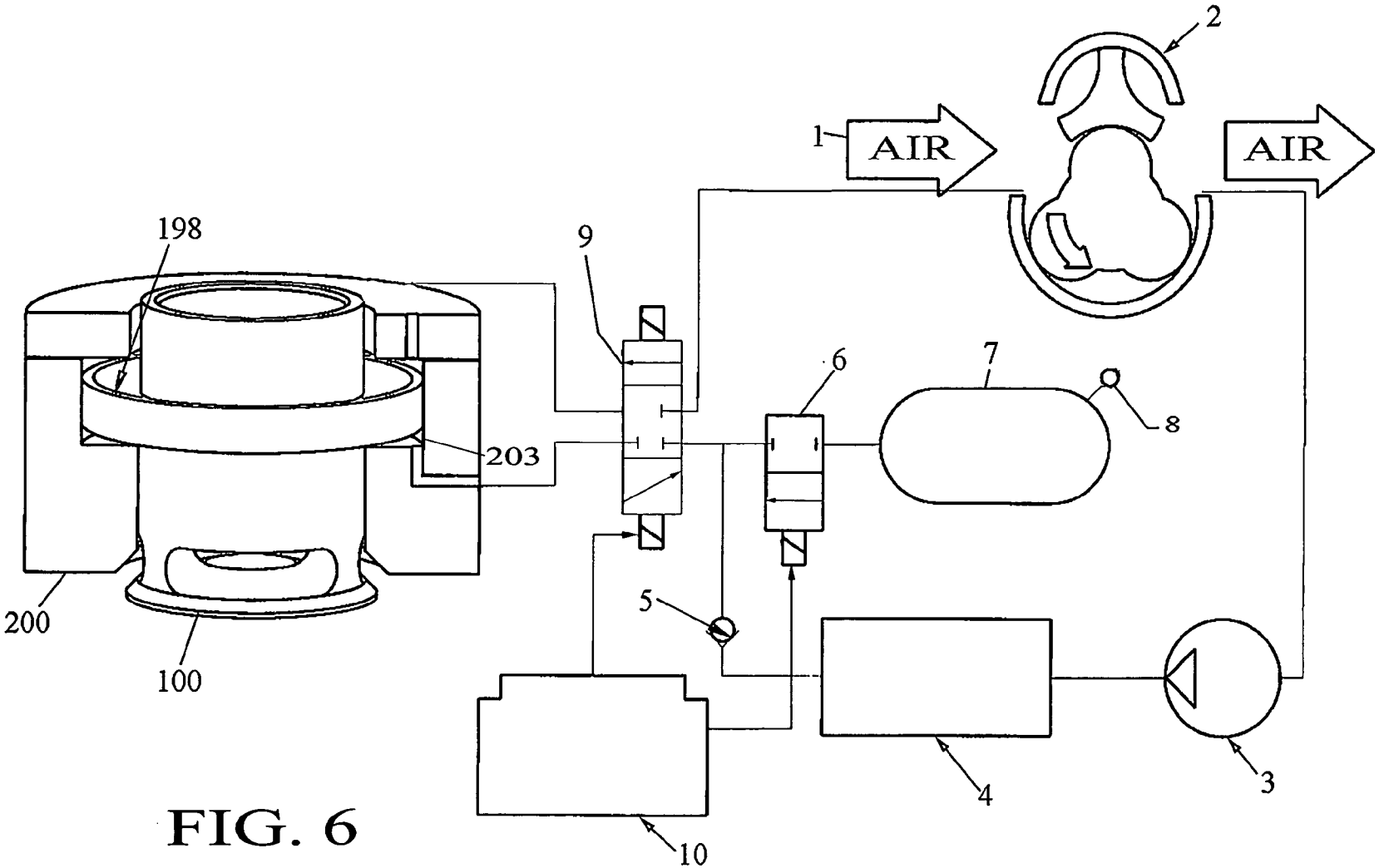
Figure 7:
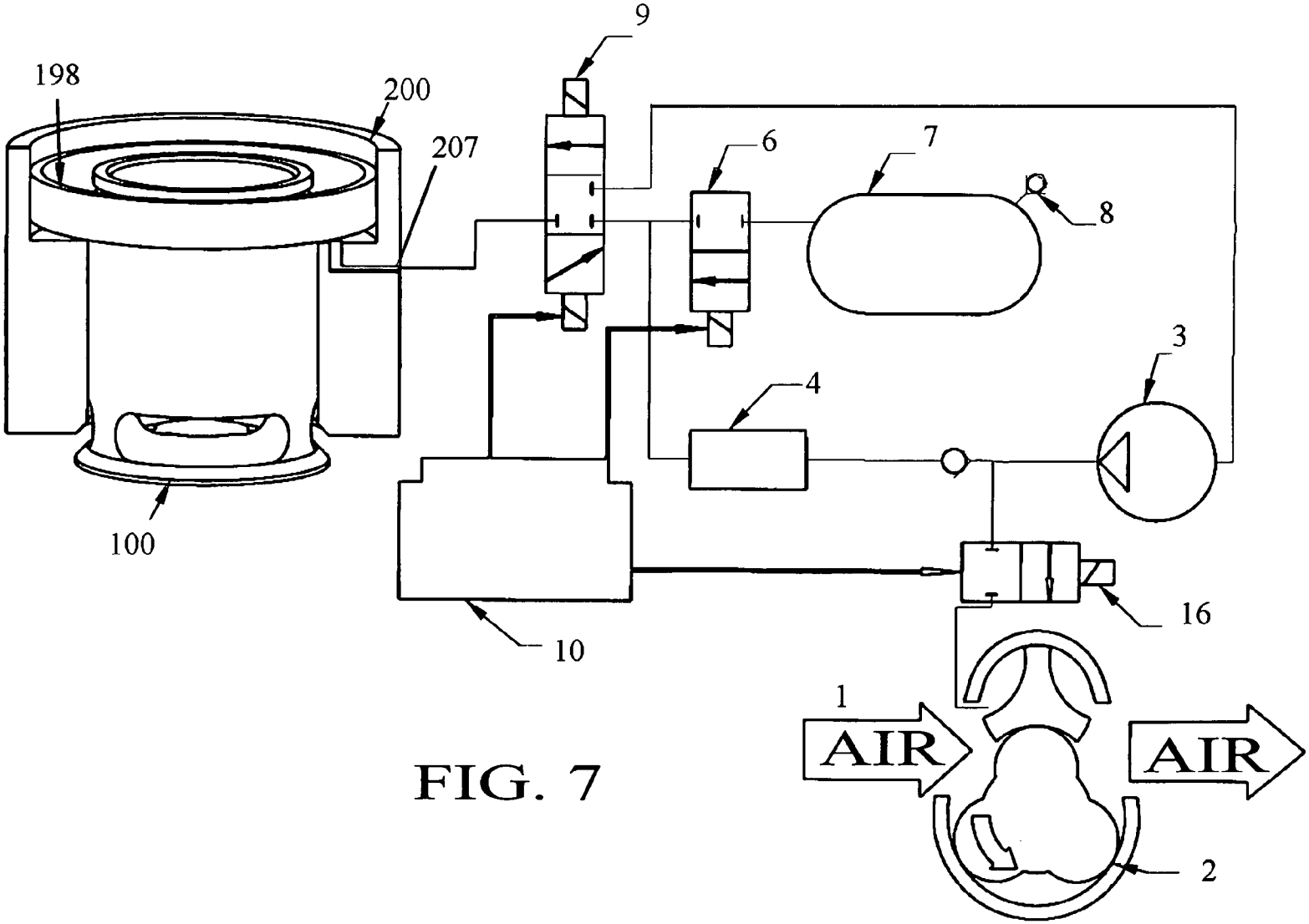
Figure 8:
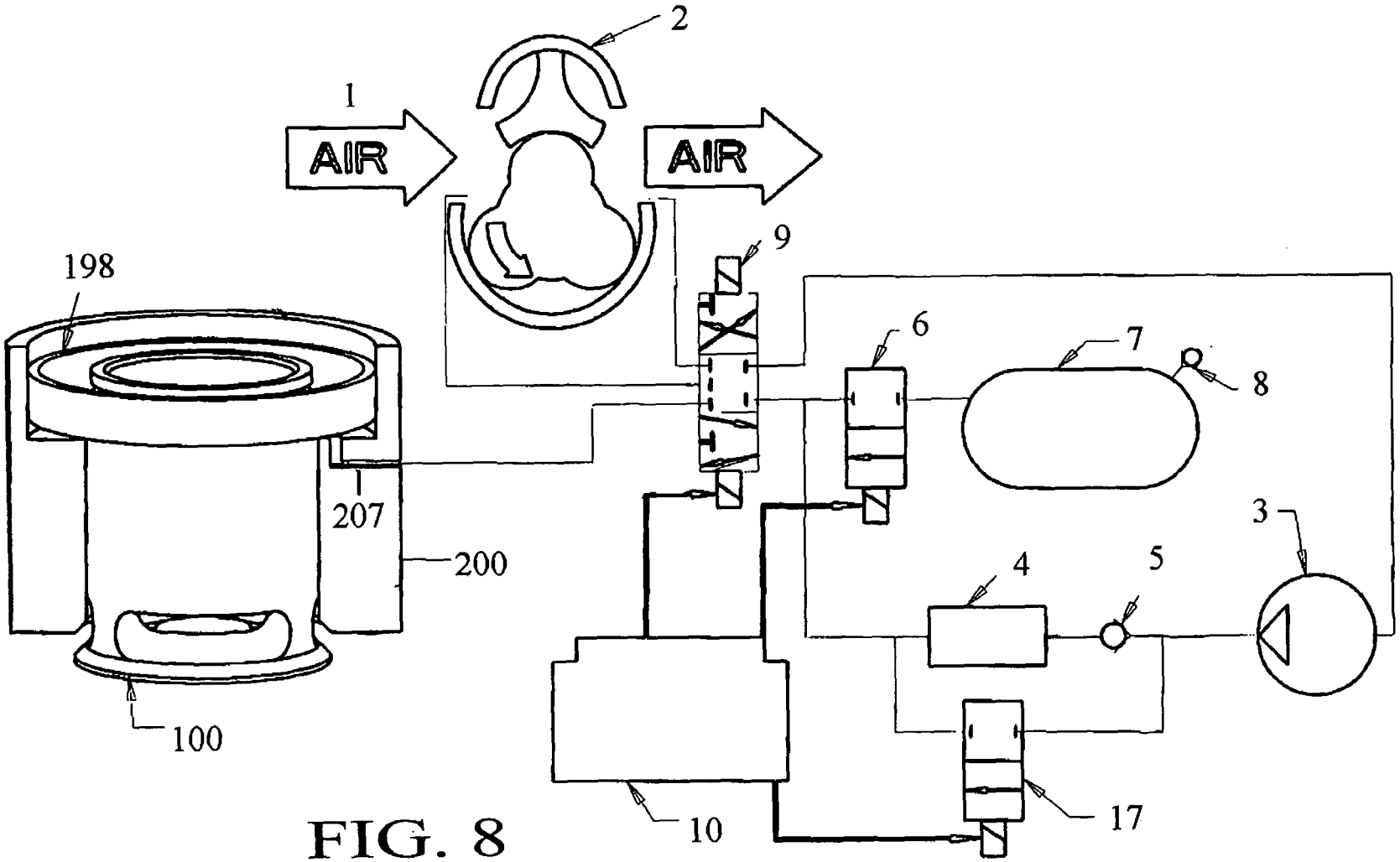

FIGS. 6–8 illustrate embodiments of the present invention in which compressed air 1 is used only to close valve 100. Therefore, valve housing 200 is not configured with a housing cap. However, each of the embodiments are further configured with a means to create a vacuum in area 203, thereby pulling the valve 100 downward and open.

FIG. 6 illustrates an air distribution and timing mechanism 300 similar to that of FIG. 1, but also including an optional vacuum pump 15. As opposed to using compressed air in the area 204 above the collar (See FIGS. 2*a*–*b*) to force the valve 100 down and open, this system uses a vaccum. Specifically, vacuum pump 15, controlled by control module 10, creates a vacuum in hollow channel 207 and the area 203 under the valve collar 198. This vacuum pulls the valve 100 downward and open. A variety of commercially-available rotary vane or piston pumps are suitable for this purpose. Thus, pressure or a vacuum in area 203 determines whether the valve is closed or open, respectively.

Similarly, FIG. 7 illustrates an air distribution and timing mechanism 300 which also uses a slight vacuum to pull valve 100 down and open. Specifically, FIG. 7 illustrates a mechanism 300 in which the programmable control module 10 controls not only the air distribution center 9 and the receiver valve 6, but also an electronic valve 16. This electronic control valve 16 opens releasing pressure from area 203. In addition, it allows the slight vacuum created by the turbocharger 2 to create a vacuum in hollow channel 207 and area 203, thereby pulling the valve 100 down and open.

FIG. 8 illustrates an air distribution and timing mechanism 300 similarly controlled by electronic control module 10 which manages the air distribution center 9, the receiver valve 6, and an intercooler bypass valve 17. In this embodiment intercooler bypass valve 17 also bypasses the one-way valve 5. When the bypass valve 17 is opened air pressure in the system and particularly, in area 203, is lost due to back flow. This back flow creates a slight vacuum which in combination with the slight vacuum created by the turbocharger 2 creates a vacuum in hollow channel 207 and area 203 and pulls the valve 100 down and open.

Exhaust valves typically require substantially more vacuum to open than intake valves. Therefore, the embodiments of the air distribution and timing mechanisms 300 illustrated in FIGS. 7 and 8 would be minimally effective for use on an exhaust valve because a conventional turbocharger would not produce sufficient vacuum to open an exhaust valve in a timely manner.

Referring back to FIG. 3, another embodiment of a forced-air distribution and timing mechanism 300 is shown that includes one or more compressed air sources 2 and an air input manifold 301. Air 1 from the compressor 2 flows through the air input manifold 301. The air input manifold 301 further includes a first connection 360 and a second connection 370 with the valve housing 200 to direct and regulate the movement of compressed air towards the valve actuation areas above 204 or below 203 the collar 198. Specifically, air 1 is directed towards the entire upper end 199 of the valve 100 to open the valve 100 and to hollow feed channel 207 to close the valve 100, from connections 370 and 360 respectively. Additionally, internally mounted on an axle 380 in the air input manifold 301 is a rotational disk assembly 302 as a means to direct air flow through the first 360 and second 370 connections. The disk assembly 302 includes one or more perforated or partially formed disks 305 fixedly mounted on the axle 380 such that rotation of axle 380 aligns the perforations or partially formed areas (i.e. 354 and 364) of the disks 305 with the respective manifold connections (370 and 360) allowing air to flow into the corresponding actuation areas above 204 and below 203 the valve collar 198. The disk assembly 302 is timed to rotate as a function of engine speed and load in order to ensure that proper valve reciprocation timing.

Figure 9:
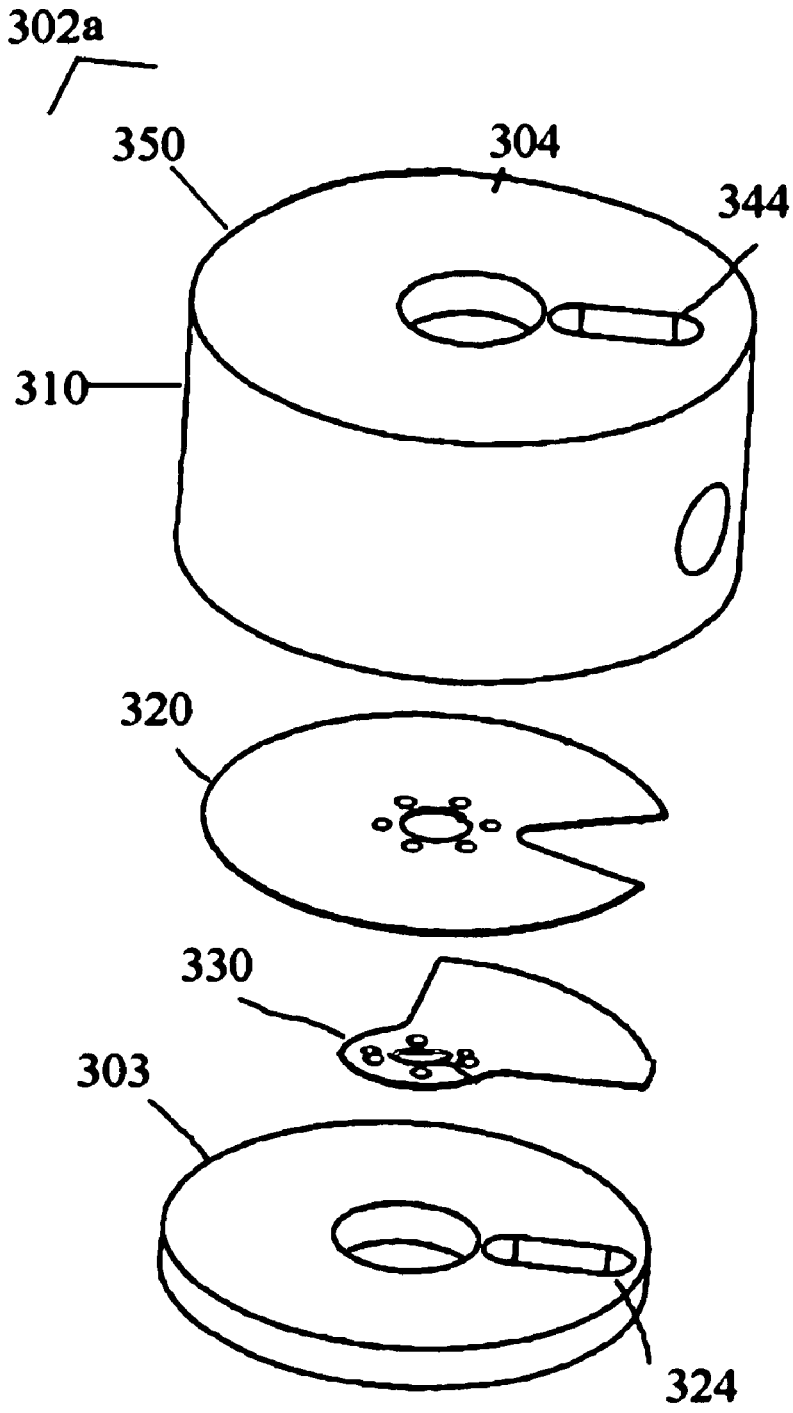
FIG. 9 is an exploded illustration of one embodiment of a rotational disk assembly as shown in FIG. 3 for regulating forced air distribution and timing.

FIG. 9 is an exploded illustration of another embodiment of a rotational disk assembly 302*a* that serves as a forced-air distribution and timing mechanism. The rotational disk assembly 302*a* is comprised of a hollow cylinder 310 with two flat ends (304 and 303). Each flat end 304 and 303 has a plurality of apertures 344 and 324, respectively. Low friction bearings (not shown) are located in the center of each flat end (303 and 304). Inside the assembly 302*a* is an axle (not shown) that is rotatably supported by the bearings. Two partially formed disks 320 (i.e. ¾ pie) and 330 (i.e. ¼ pie) or perforated disks are fixedly attached to the axle and each mounted approximate to ends 304 and 303, respectively. The apertures 344 and 324 align to direct air flow towards a corresponding actuation area, (i.e. over upper end 199 or into hollow air feed channel 209 and into hollow air feed channel 207). Upon rotation of the axle about the bearings, the disks (330 and 320) are rotated and when the perforations are aligned with apertures 344 or 324 at regular intervals, air is allowed to pass there through.

The above-described embodiments of the present invention, inclusive of the pneumatically actuated valve itself, plus forced air distribution and timing mechanisms for controlling the valve, solve the problems and eliminate the disadvantages associated with conventional valves and camshafts on two- and four-stroke internal combustion engines. They provide an assembly that is simple and straightforward, fabricated of strong, durable, resilient materials appropriate to the nature of their usage, and may be economically manufactured and sold. Additionally, implementation of the present invention will increase fuel economy while reducing the emissions of pollutants associated with the operation of conventional two and four stroke internal combustion engines.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

INDUSTRIAL APPLICABILITY

Engine valves have traditionally been actuated by a cam affixed to a cam shaft. These cam shafts are costly and inefficient. There would be significant commercial value in a wholly pneumatically actuated valve system (by means of supplied compressed air or other pressurized gas). The system would include a pneumatically actuated valve with a valve housing, a forced air distribution and timing mechanism for controlling the valve, and one or multiple air sources to more efficiently regulate the timing of the valve open/close (reciprocation) cycle relative to the engine speed. Such a wholly pneumatically-actuated valve system could be used either as an air intake valve or exhaust valve or both on either a two or four stroke internal combustion engine to increase efficiency and conserve manufacturing cost.

The invention claimed is:

1. A pneumatically actuated valve assembly for an internal combustion engine, comprising:

a pneumatic valve comprised of a hollow cylindrical body having an open upper end, a lower end closed and circumscribed by an annular valve seat, a plurality of radially-spaced ports adjacent said lower end and in fluid communication with the open upper end, and an annular collar above said plurality of ports;

a valve housing formed in a cylinder wall of said internal combustion engine, said housing comprising a larger diameter upper section for slidably receiving said valve collar, and a smaller diameter lower section for slidably receiving the cylindrical body of said pneumatic valve and for engaging said valve collar to limit further sliding of said valve, said lower section opening to a combustion chamber of the engine;

whereby when said pneumatic valve is in a downward position said valve collar abuts said smaller diameter lower section and said ports remain open to the combustion chamber of the engine to allow gas flow, and when said pneumatic valve is in an upward position said ports are closed to prevent air flow to the combustion chamber of the engine.

2. The valve assembly of claim 1, wherein said valve is approximately equal in length to the thickness of the engine cylinder wall.

3. The valve assembly of claim 2, wherein said valve housing comprises a first air feed channel connecting a compressed air source to the lower section for forcing the valve to slide to said upward position.

4. The valve assembly of claim 3, wherein said valve seat mates with said valve housing when the valve is in said upward position to prevent air and other gases from flowing through the valve.

5. The valve assembly of claim 4, wherein directing compressed air over the upper end of said pneumatic valve forces the valve to slide downwards in the valve housing and allow the flow of air and other gases through the valve into the combustion chamber of the engine.

6. The valve assembly of claim 4, wherein said valve housing is capped by a housing cap that covers the exposed valve collar but not the open upper end of the valve body.

7. The valve assembly of claim 6, wherein said cap is defined by a second air feed channel connecting a compressed gas source to said upper valve housing section.

8. The valve assembly of claim 1, wherein pneumatically actuating the valve assembly to slide the valve into the open downward position and/or closed upward position is controlled by a compressed air distribution and timing mechanism.

9. The valve assembly of claim 8, whereby said distribution and timing mechanism includes an air or other gas source selectively manifolded to the upper and lower sections of said valve housing.

10. The valve assembly of claim 9, whereby said distribution and timing mechanism includes a programmable electronic control module.

11. The valve assembly of claim 9, wherein said distribution and timing mechanism further comprises a turbocharger, compressor, and intercooler.

12. The valve assembly of claim 10, wherein said distribution and timing mechanism comprises means for creating a vacuum in the lower valve housing section to pull the valve to its downward open position.

13. The valve assembly of claim 12, wherein said vacuum means comprises a vacuum pump connected to and controlled by said programmable control module.

14. The valve assembly of claim 11, wherein said vacuum means comprises an electronic valve, connected to and controlled by the programmable control module, which when open utilizes the vacuum necessarily created by said turbocharger to create a vacuum in the area below the valve collar.

15. The valve assembly of claim 11, wherein said vacuum means is comprised of an intercooler bypass valve, which also bypasses said on-way valves, such that when the intercooler bypass valve is open back-pressure is created; said back-pressure in combination with the slight vacuum necessarily created by the turbocharger creates a vacuum in the area below the valve collar.

16. The valve assembly of claim 8, wherein said distribution and timing mechanism is comprised of one or more compressed air sources connected to an air input manifold, said air input manifold comprising first and second connections to the valve assembly to direct compressed air flow into the area above the valve collar and to direct compressed air flow into the area below the valve collar, respectively, in order to actuate valve reciprocation; said air input manifold further includes a rotational disk assembly rotatably mounted on an axle within said manifold; said rotational disk assembly comprised of one or more perforated or partially formed disks fixedly mounted on said axle such that rotation of the disks about the axle aligns the perforations or partially formed areas of said disks with the respective manifold connections allowing air to flow into the corresponding areas above and below the valve collar.

* * * * *